United States Patent [19]

Nwoko

[11] Patent Number: 5,050,915

[45] Date of Patent: Sep. 24, 1991

[54] SPRING ACTUATED FASTENING DEVICE WITH WIDTH/TENSION ADJUSTMENT CAPACITY

[76] Inventor: Luck Nwoko, 1629 Columbia Rd., NW., Apt. 110, Washington, D.C. 20009

[21] Appl. No.: 597,475

[22] Filed: Oct. 3, 1990

[51] Int. Cl.[5] ..... E05C 19/02

[52] U.S. Cl. ..... 292/16; 292/DIG. 50

[58] Field of Search ..... 292/14, 15, 16, 73, 292/74, 75, 275, 277, DIG. 50

[56] References Cited

U.S. PATENT DOCUMENTS

| | | | |
|---|---|---|---|
| 272,902 | 2/1883 | Roemer | 292/16 |
| 2,038,835 | 4/1936 | Frost | 292/16 |
| 2,465,088 | 3/1949 | Gussack | 292/275 X |
| 3,129,024 | 4/1964 | Schuessler et al. | 292/15 |

*Primary Examiner*—Richard E. Moore

[57] ABSTRACT

A fastening device for bags, luggages and other receptacles with width/tension adjustment capacity incorporated within the engagement structure of the fastener is disclosed. The fastening device comprises a u-shaped casing and pairs of opposing spring actuated catches which engage with a rigid depressant member of a keeper unit in a coupling or locked position.

25 Claims, 11 Drawing Sheets

FIG.8
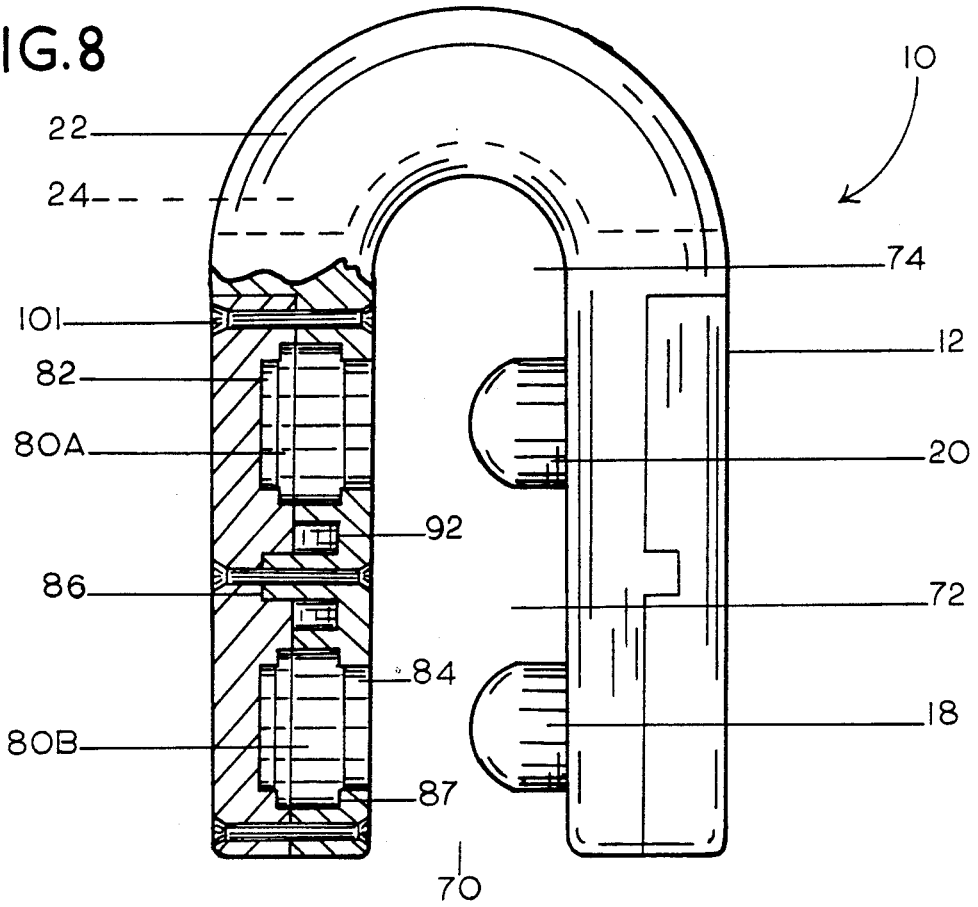
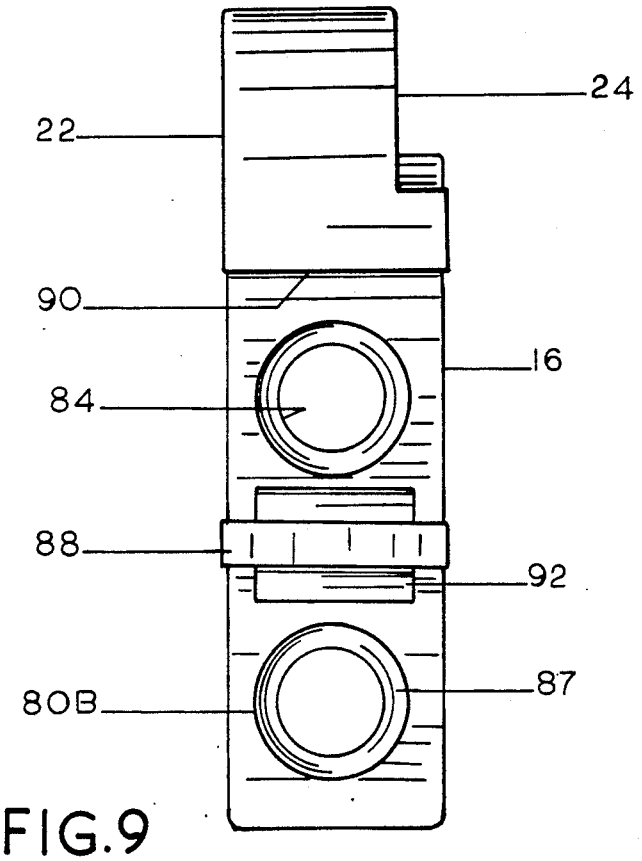
FIG.9
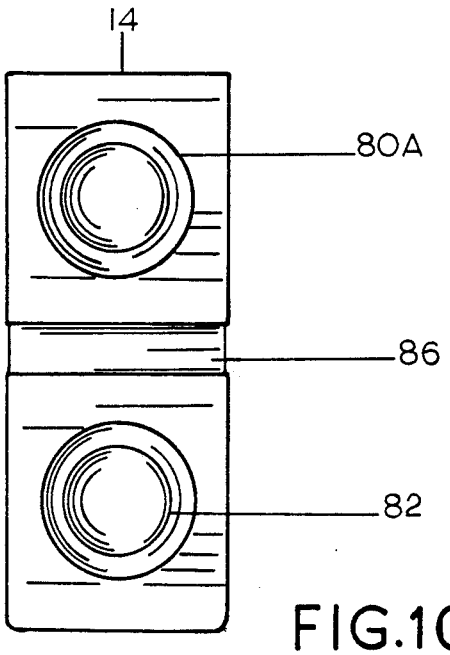
FIG.10

FIG.12
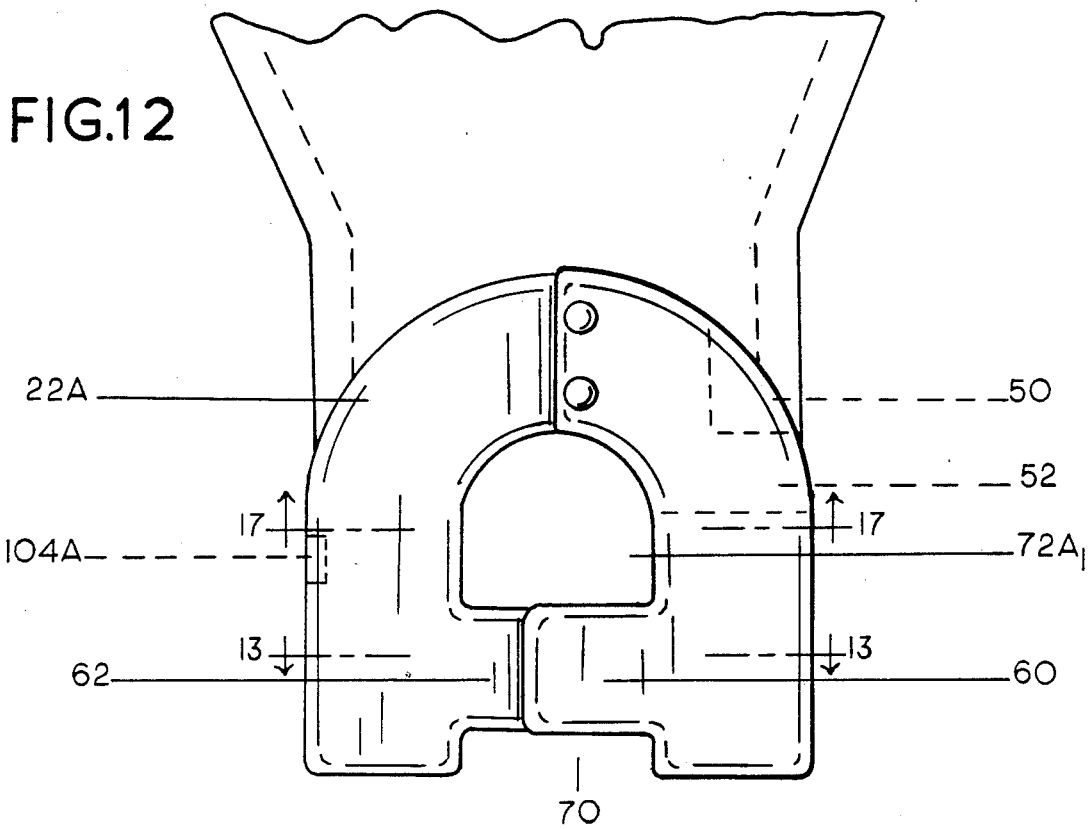
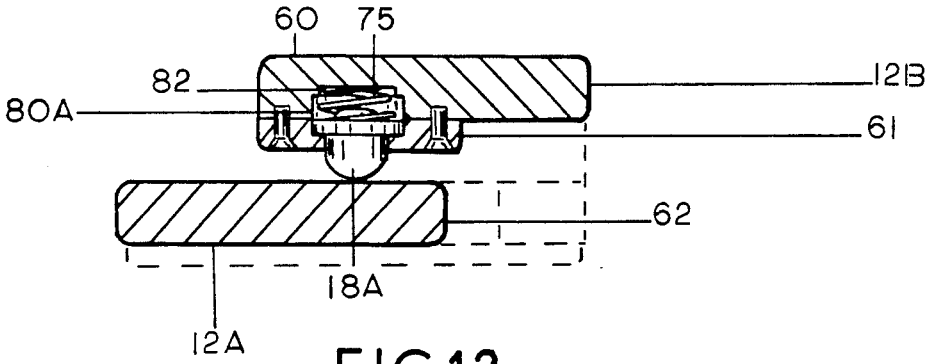
FIG.13
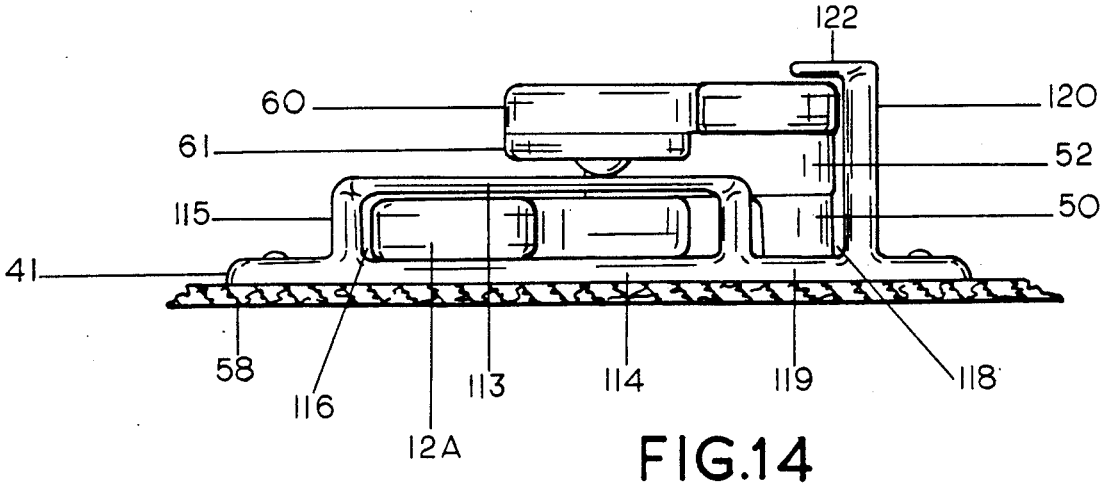
FIG.14

FIG.15
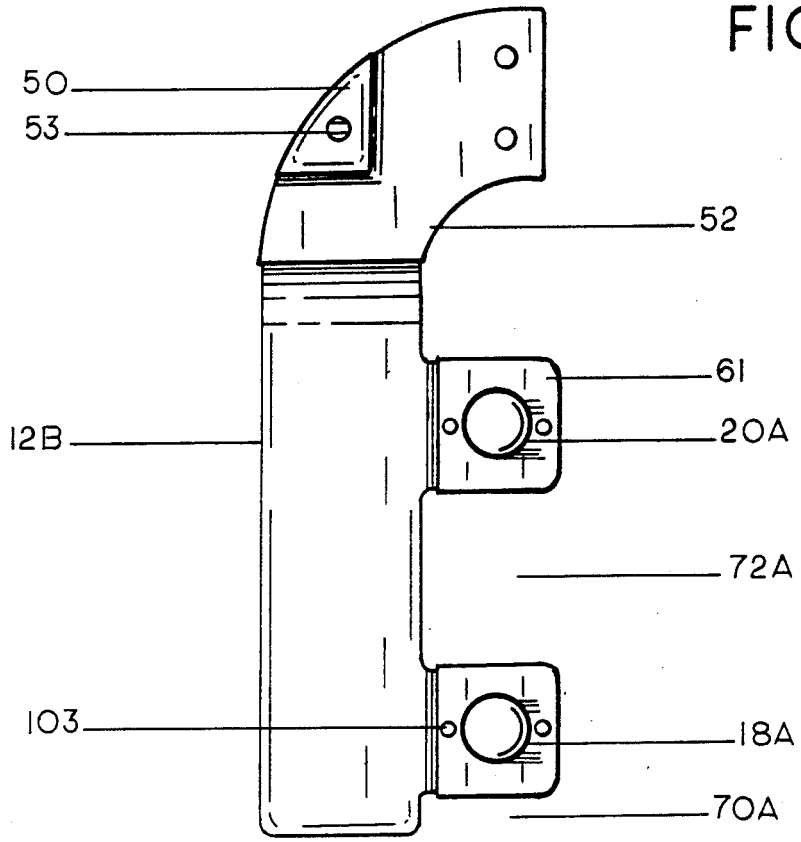
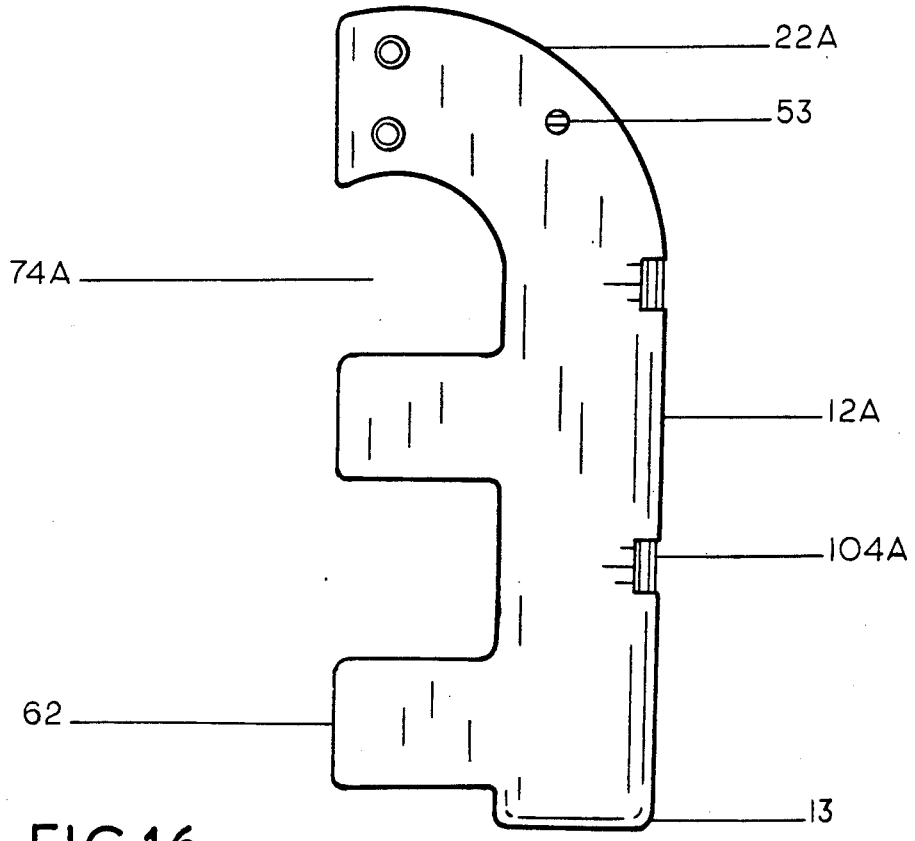
FIG.16

SPRING ACTUATED FASTENING DEVICE WITH WIDTH/TENSION ADJUSTMENT CAPACITY

TECHNICAL FIELD

This invention relates, in general, to fastening systems and more particularly to a fastening device for bags, luggages and other receptacles which comprises a u-shaped body or casing and pairs of opposing spring actuated catches or hook members so arranged as to engage with and depress from a rigid depressant member of a keeper unit in a coupling or locked position.

The primary object of this invention is to provide a fastening device for bags, luggages and the like, as well as trunks and other stationary receptacles having closeable lids or tops, which may be economically manufactured and assembled and which will give an efficient and durable service.

Another object is to provide a fastening device for luggages in which the fastening system allows for width/tension adjustment capacity within the engagement structure of the fastener without having to disengage the fastener.

A further object is to provide a fastening device of the type described in which (a pair of) grooves or slots are positioned on one of the descending arms to engage with a cooperating conventional locking member, thus functioning as a hasp, and preventing disengagement as a result of lifting a loaded bag or luggage by its handle (particularly when said handle is attached to the same cover flap as the fastener).

Furthermore, while functioning mechanically interiorly, the outer surface of the associated parts have substantially smooth, flush lines and present an aesthetically pleasing appearance.

BACKGROUND OF THE INVENTION

The present invention is a mechanical and critical improvement of a patented fastening device (U.S. Pat. No. 4,916,833) for shoes, clothing and the like which I invented. The aim of the improvement is to create a fastening system which is made more adaptable and efficient for use with bags, luggages and the like by providing the catch members with compressed spring actuation, thereby allowing for a greater control of the tensility or tautness of the engagement modality.

While prior art has aptly demonstrated that the unification of the laterally spaced, rigid, pliant and sinuous side members of the said patented fastener provides innate elasticity to the system, there is always the problem of the retardant effect of friction at the points where the restrictive entrants of the fastener makes contact with a proposed rigid engaging or copula element.

It is my proposal therefore, that by providing the fastening system with spring actuated catch members, the attendant problem of friction will be vitiated. Consequently, the present configuration alacriates the coupling/uncoupling capacity of the fastening system, while at the same time providing a unique width/tension adjustment capacity.

SUMMARY OF THE INVENTION

The present invention relates to a fastening device for bags, luggages and the like which provides pair(s) of aligned, opposing, compression spring actuated catches shaped to engage with a depressant element of a cooperating keeper unit. The opposing (through coaxially spaced bearings on the laterally spaced descending arms of the fastener) pairs of spring biased catches come together to form restrictive entrants which expands under the pressure of the depressant member of the copula keeper unit. The present invention is also directed to an ancillary opening which provides width/-tension adjustment capacity as an integral part of the fastening device. The ancillary or secondary opening is a continuum, albeit a bifurcated one, of the primary opening. In a preferred embodiment, the fastening device is made of cast metal or plastic with an arcuated posterior which descends to form two arms. In order to effectively mount the catch/spring elements, the descending arms of the fastener may be formed of two conjoined, cam-like, segments or bars—an inner bar which is contiguous with the arced posterior, and a separate conjoining outer bar (like a scion upon a stock)—and provided with appropriate transverse cavities or bores for the said catch/spring arrangement, and are rigidly secured together by any suitable means, as for example, a plurality of rivets or solder or other adhesive or both. The arced posterior portion may be provided rear-wardly with a groove or depression with threaded apertures for the securement thereto of a closure flap, strap or lid.

In a preferred embodiment, the catch elements are solid cylindrical shafts with collars or annular flange bases and hemispherical convex or rounded anteriors. The rigidly joined bars of the fastener arms (conjointly) form annular rearward depressions for the containment and abutment of the lower ends of the springs, main cylindrical bores or chambers, and foreward annular through openings or bearings which by communicating with the main chambers form projecting rims which, in turn, form abutments against which the collar of the catches rests. Said annular bearings opens through the flat surfaces of the inner bars into the bight formed by the lateral arms and the arcuated top, all providing for the transverse, slideable movement of the spring actuated catch elements. Rearwardly, the catch collars are provided with hub-like central portions or plugs which provide seats for the upper ends of the compression springs. Said springs are preferably pre-set units.

The spring/catch combinations are so located and positioned that the catches are held in either a locking or opening position. When the aligned, opposing pairs of spring actuated catches are brought together in position, they are automatically positioned and the central lug or rigid depressant element of the keeper unit is located correctly for engaging with the smooth, rounded outlines of the opposing catches which are then depressed laterally for the entrance and registration of the depressant element within the confines of the primary, essentially quadrilateral opening.

The integral, ancillary opening of the present invention provides width/tension enhancement capacity to the fastening system. The width adjustment capacity (and concomitant increased tension) is achieved simply by advancing the fastening device from its primary engagement mode, so that the central depressant member of the keeper unit (which is secured to the body of a bag) will engage with the second pair of aligned, opposing spring actuated catches, depress them apart and enter into registration with the ancillary opening.

The proposed depressant/keeper unit which is securely attached, at its right angled lateral lugs by means of rivets, prongs or the like, to the body of a bag (and aligned to receive, longitudinally, the incoming fastening device) is preferably made of cast metal or plastic and comprises two bifurcated channels or passage ways which are substantially horizontal and rectangular in cross-section and structured to permit the relatively smooth, longitudinal movement of the fastening device (prior depressant/opposing catches engagement). The depressant element divides the keeper unit into the two receiving channels.

The intermediate depressant element of the keeper unit further has beveled, smooth ends to provide an effective outline for engagement with the correspondingly rounded outline of the opposing catches. The depressant is effective to depress the opposing pairs of opposing spring actuated catches a substantial lateral distance.

The receptive widths of the above stated channels are such that they will smoothly receive and cause interengagement with the fastening device passing therethrough, and also by such embracing engagement maintain said fastener within the confines of the channels.

It will be readily appreciated by those skilled in the art that the provision of preset compression springs in the articulation of the catch elements presents a great advantage in the ability of the manufacturer of the present invention to determine the range of required tensility, and the fullfilment of specific calculations or conditions within the systems.

A bag, luggage and the like with a spring actuated fastening device of the kind here-in-above described can be quickly and easily fastened. Furthermore, and most critically, the present invention provides integrated automatically engagable secondary opening and based on its contiguous perpendicular alignment provides accessible and immediate width/tension capacity.

A particularized presentation of the aforestated improvements and a detailed exposition of the proposed copula keeper/depressant unit are hereinafter set forth and are more particularly defined by claims at the conclusion hereof.

For a better understanding of the invention and the advantages thereof, reference should be made to the following descriptive matter taken in conjunction with the accompanying drawings.

BRIEF DESCRIPTION OF DRAWINGS

FIG. 8 is an elevated front view of the invention with a broken section (without the spring/catch elements).

FIG. 9 is a side view of the invention showing the interior bar of the arms.

FIG. 10 is a side view of the exterior bar.

FIG. 12 is an elevated front view of a single opening version of the modified fastener.

FIG. 13 is a sectional, detail view of FIG. 12 taken along line 13—13.

FIG. 14 is an anterior, side view of the modified fastener as it engages with proposed keeper unit.

FIG. 15 is an elevated, rear view of the modified invention, showing the overlapping segment of the fastener.

FIG. 16 is an elevated, rear view of the overlapped segment of the modified fastener.

DETAILED DESCRIPTION OF THE INVENTION

Figure 1:
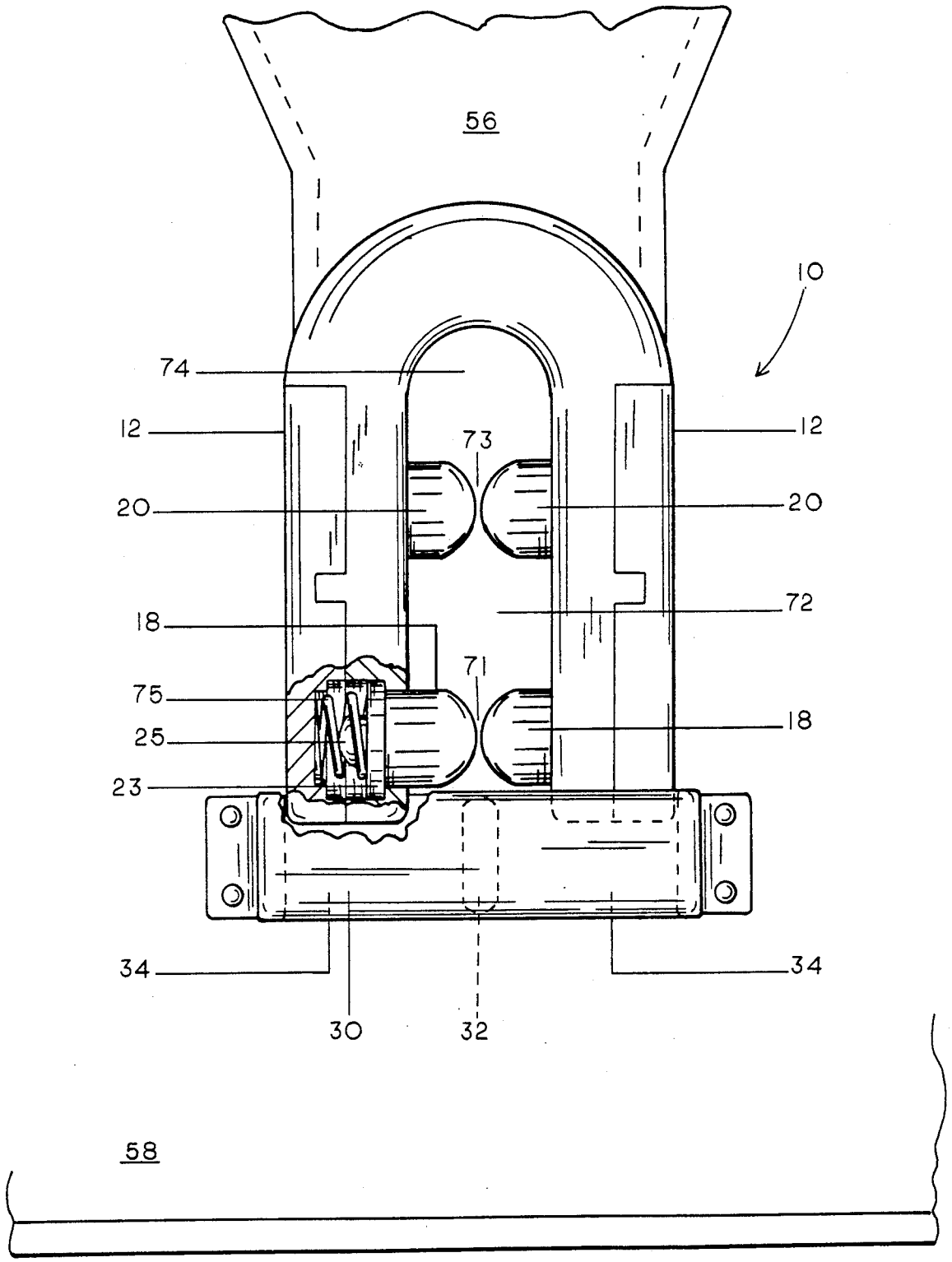
FIG. 1 is an elevated front view of the invention.

The bag or luggage fastener device 10 10 shown in FIG. 1 comprises a u-shaped body or casing with two laterally spaced descending arms 12 carrying two pairs of aligned, opposing, compression spring actuated beveled catches, 18 and 20, shaped to smoothly engage with and be depressed away from the rigid, intermediately aligned lug or depressant member 32 of the proposed copula keeper unit 30 which is fixedly attached to bag or luggage body 58. The two pairs of projecting, aligned, and opposing, spring actuated catches, 18 and 20, are transversely, moveable mounted (through coaxially spaced bores or bearings 84 on the lateral arms 12) and come together to form restrictive entrants 71 and 73 which expand under the pressure of the central, rigid depressant 32.

The tensility of the system, or the degree of resiliency proffered by the opposing and restricting catch pairs 18 and 20, and, consequently the copula modulation, is determined by the stiffness or tautness of the coiled, compression springs 75. Compression springs 75 are preferably pre-set units.

It should be noted that the opposing compression spring actuated catch pairs 18 and 20 are so located and positioned that said catch members are held in a locking or opening configuration with respect to the engaging depressant 32. Compression spring 75 should contain sufficient stress to ensure that in practical use the pairs of aligned, opposing catches 18 and 20 will constantly attain the necessary (at-rest) extension and, conversely, said catch members can be moved or depressed against the action or at-rest state of compression spring 75 (opening), and automatically 'fly-out' (towards each other) under the action of spring 75 (closing or locking).

As the fastening device 10 is advanced to interengage, via introductory opening or mouth 70, with the receiving keeper unit 30, the intermediate depressant 32 is operative to depress the opposing spring actuated catch pair 18 a substantial distance, laterally, to allow for the entrance, via entrant 71, and registration of depressant 32 within the essentially quadrilateral primary opening 72. A subsequent linear advancement of fastener 10 within the confines of the bifurcated channels or passage ways 34 allows for the rounded and smooth outline of depressant 32 to enact a repeat camming action in connection with the second pair of opposing, spring actuated catches 20, depressing said secondary catches, via entrant 73, and registering within the confines of the essentially arced secondary opening 74. The automatically accessible, integrated, linear but bifurcated mode of the ancillary or secondary opening 74 provides the fastening device system with its width/tension adjustment capacity.

It must be noted that the pre-set tensility of springs 75 determines the fastening system's ability to prevent the engaged depressant element 32 from passing restrictive entrants 71 and 73 in either direction without some pressure being applied thereto.

Figure 3:
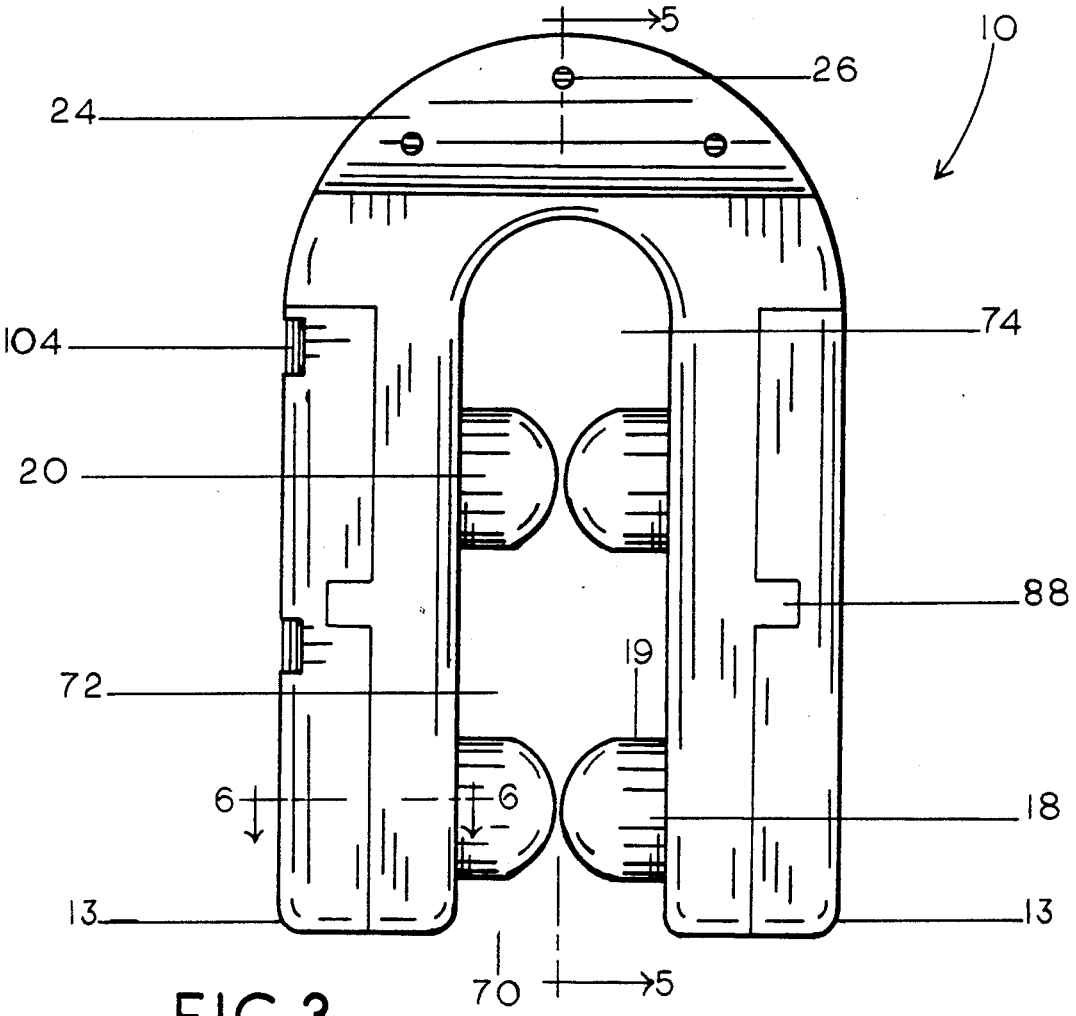
FIG. 3 is a rear view of the fastener showing the optical lateral arm grooves.

In a preferred embodiment, fastening device 10 is made of cast metal, plastic or any other suitable material. As shown in FIG. 3, the arced posterior portion 22 is configured with a rearward groove or depression 24 which is provided with a plurality of threaded apertures 26 for the attachment thereto of a bag strap or flap 56. Referring to FIGS. 8 and 9 arced portion 22 descends and inclines at right angles to form posterior counter walls 90 and goes on to form two laterally spaced, descending, contiguous inner bars or sections 16 which are provided with pairs of cylindrical portional bores or cavities 80B, smaller, centered, within said bores 80B, annular through-openings or bearings 84 which connect with portional bores 80B to form rims 87, intermediate projection plugs 88 which interfit with socket member 86 (of outer conjoining bars 14), and twin pairs of substantially rectangular cavities or depressions 92 (to provide lightness to the bars) which straddle said projecting plug members 88. Said plug members project at right angles.

Referring to FIG. 10, the separate outer conjoining bars 14, are provided with appropriately positioned, cylindrical portional bores 80A, smaller, centered (within said bores 80A), annular recessions 82 which provide rearward containment, abutment as well as self-centering capacity to spring members 75, and receptive, intermediate, essentially rectangular, transverse sockets 86 adapted to interfit with projecting plugs 88.

The proposed dichtomization of the lateral arms 12 into inner and outer bars 14 and 16 is for the effective mounting of spring members 75 with catch pairs 18 and 20. Bars 14 and 16 are fixedly connected to each other and maintained in rigid relation to each other preferably by a plurality of rivets 101, or by soldering or welding, by counter walls 90 and by the inter-locking plug 88/socket 86 connection.

Figure 6:
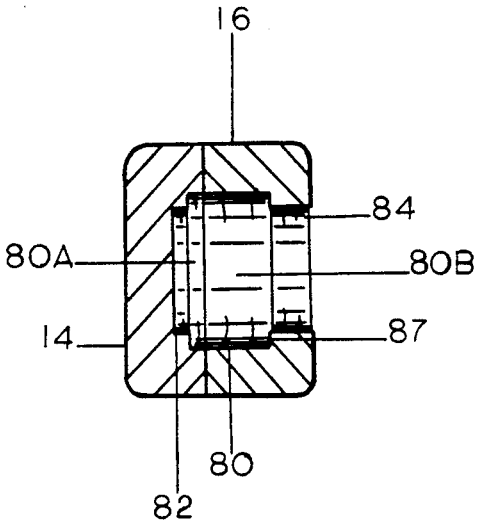
FIG. 6 is a sectional view of FIG. 3 taken along line 6—6 (without the spring/catch elements).

Referring to FIGS. 6 and 8, said bars 14 and 16 conjointly form integrated cylindrical main chambers 80, rear annular recesses 82 and foreward annular through-openings or bearings 84 which form rims 87—all aligned in tranversal pairs. Main bores 80 provide cylindrical chambers within which the two pairs of transversely aligned and opposing pairs of catches, 18 and 20, along with their rearwardly placed, supporting compression springs 75 are moveably mounted—said pairs of opposing catches 18 and 20 being made to project beyond the planes of the outer surfaces of the inner bars 16 and coming together to form restrictive entrants 71 and 73.

The catch pairs 18 and 20 are preferably made of cast metal or plastic. Round, pluglike in body formation, said catch elements preferably have solid cylindrical shafts 19 with hemispherical convex or rounded anteriors 21 and rear annular flanges or collars 23. Rearwardly, catch collars 23 are provided with hub-like central portion or plugs 25 which provide self-centering engagements with the front ends of springs 75. In its fully extended, locking positions, said catches are retained by the oppositionality of collars 23 and the metered bearing rims 87—a catch abutment, defined within the structure of the transverse cavities.

When the pairs of aligned, opposing spring actuated catches 18 and 20 are brought together in locking positions, they are automatically positioned, and said beveled, central depressant 32 of keeper unit 30 is located correctly for engaging with the smooth, rounded outlines of said opposing catch pairs.

Figure 2:
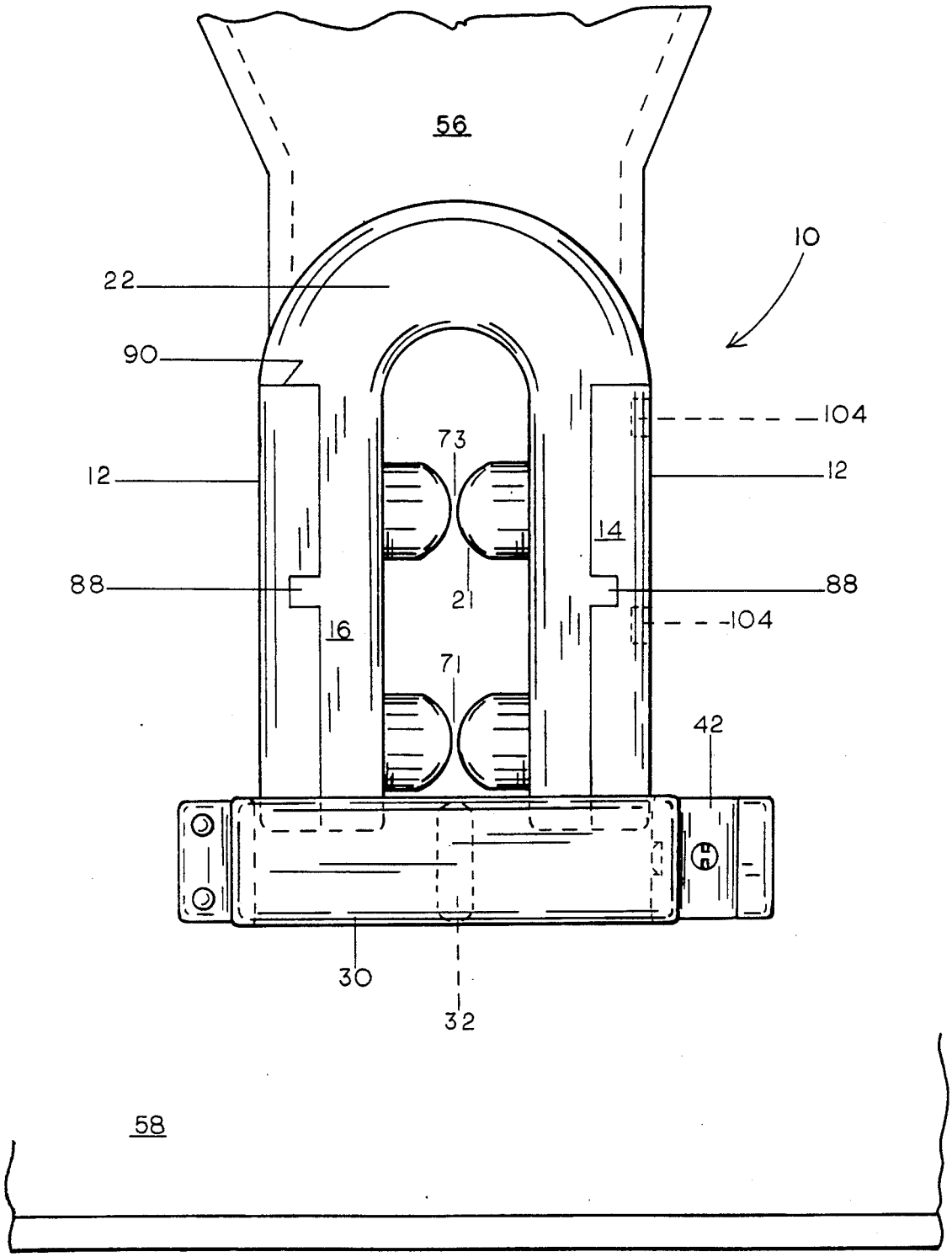
FIG. 2 is an elevated front view of the invention.
Figure 4:
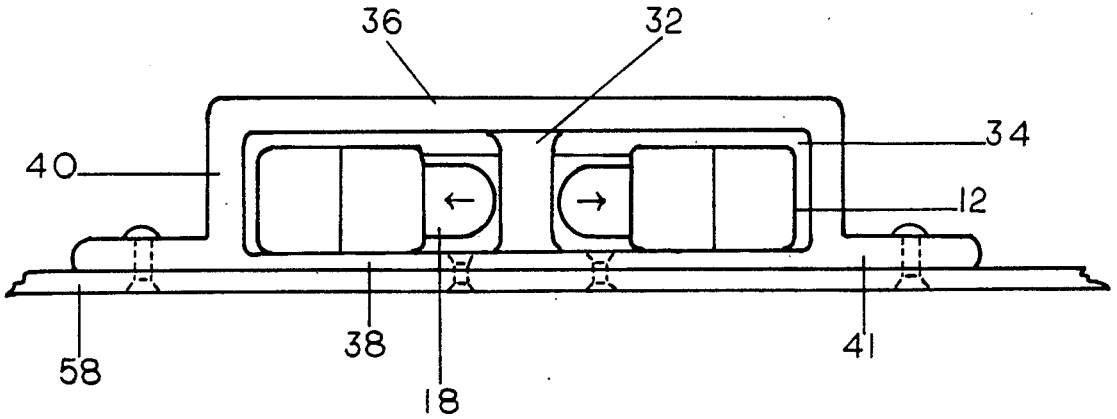
FIG. 4 is a schematic, perpendicular or orthographic side view of the anterior of the fastener (as it engages with proposed keeper unit).
Figure 5:
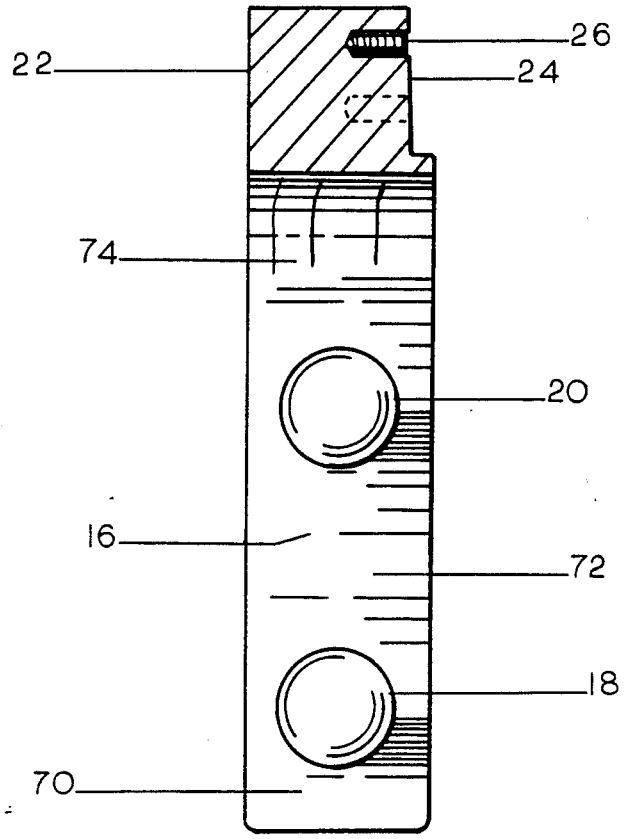
FIG. 5 is a sectional view of FIG. 3 taken along line 5—5.

Referring to FIGS. 2 and 4, the proposed keeper unit 30 is preferredly formed of cast metal or plastic or blanked to the desired form. Said keeper unit 30 is rectangular in form when viewed in plan, with bifurcated channels 34, which are substantially rectangular and horizontal in cross-section, said channels being portioned by bevel ended depressant 32 which is integral with top plate 36 and bottom plate 38, keeper unit 30 is provided with integral, lateral lugs 41 at the base of the marginal portions or walls 40, said keeper unit is securely attached, at its lateral lugs, by means of prongs, rivets or the like to the body 58 of a bag or luggage and aligned to receive incoming fastening device 10.

Passage-ways 34 are structured to permit the relatively smooth, longitudinal movement of fastening device 10 prior to depressant 32/opposing catches 18 or 20 engagements.

It is to be noted that fastening device 10 is sometimes located along the periphery of a bag or luggage closure flap to which also a handle is attached. Consequently, fastening device 10 in an alternate embodiment (FIGS. 2 and 3) may be provided at the rearward, outer periphery, or laterality of one of its arms with grooves or slots 104 to engage laterally with a cooperating conventional locking member 42, thus imbuing said arm with a hasp-like capacity, and preventing disengagement as a result of lifting a loaded bag or luggage by the handle. Grooves 104 are centrally aligned with respect to openings 72 and 74.

Although the invention has been described with reference to a particular embodiment, other configurations can be made without departing from or sacrificing any of the advantages of the invention. For example, in a modified form (FIG. 11), it will be seen that the descending arms 12A and 12B overlap one another so that their inwardly perpendicular or transverse members 60 (12B) and 62 (12A) combine, with the assistance of the downwardly projecting spring actuated beveled catches 18A and 20A, to form introductory opening 70A, restrictive entrants 71A and 73A and openings 72A and 74A. A substantially rectangular, horizontal and angulated engaging or copula unit 110 provides reception and inter-engagement with this overlapping embodiment.

The modified form, like the original, should be made of cast metal or plastic. In order to effectively mount springs 75 with catches 18A and 20A within the heads of overlapping transverse members 60, the arms 12A and 12B along with their semi-arced posterior portions 22A and 22B respectively are of necessity formed separately, and then rigidly, posteriorly conjointed at lap joint 64 (FIG. 17) by means of double riveting, elements 102, soldering or welding.

FIGS. 15 and 16 show the rearside of the separated members 12A and 12B and their posterior portions. Member 12B (FIG. 15) shows the stepped or staggered rear-face of semi-arced posterior 22B—with a projecting, lateral spur or boss member 50 which is provided with threaded aperture 53 and perpendicular to a flat, metered elevation 52 from which it arises. Said metered elevation 52 overlaps and is rigidly attached to a correspondingly flat area of semi-arced posterior 22A.

Figure 21:
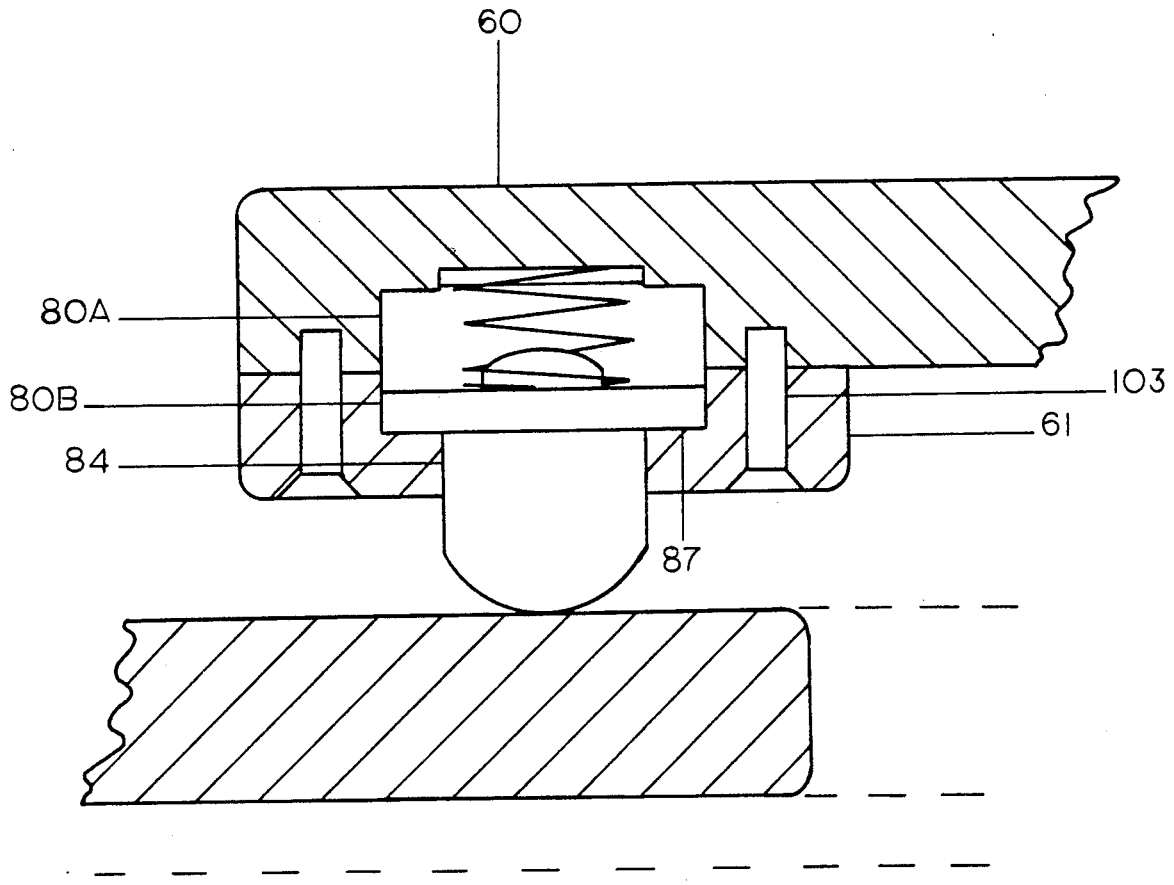
FIG. 21 is an enlarged, sectional, schematic detail view of FIG. 13.

As shown in FIGS. 13 and 21, the rearside head portion of the overlapping, transverse members 60 are provided, albeit on a smaller scale, with posterior annular recesses 82, for the abutment and containment of compression springs 75 and cylindrical portional bores 80A which are conjoined, cam-like, by rivets 103 or other means of securement with essentially rectangular, flat under plates 61 which are correspondingly provided with matching cylindrical portional bores 80B which connects with annular through-openings or tearings 84 and forming rims 87—all fixedly aligned to provide for the transversal, slideable movement of the mounted compression spring 75/catches 18A/20A associations. As in the original, similar appellations within the catch bearing structure provide similar functions.

Compression springs 75, as in the original, are preset units. Catches 18A and 20A, although smaller, are of the same shape and configuration as the original—a cylindrical body with hemispherical convex or rounded anteriors and collar bases. The annular through openings or bearings 84 provide outlets for the downwardly projecting catches as well as the catch abutment capacity of rims 87.

In its fully extended, locking or rest-state, the anterior portions of catches 18A and 20A rest their beveled tips, in a perpendicular alignment, on the top surface of the underlyng transverse members 62 to form restrictive points 71A and 73A.

As shown in FIG. 14, the perpendicular vertical articulations of spring actuated catches 18A (and 20A) are effectively cammed or depressed upwardly by the engagement of the horizontally aligned, bevel ended top plate/depressant 112 of the receiving keeper unit 110; thus, allowing for the entrance and registration of the receiving unit 110, in an inter-engagement mode, within the substantially quadrilateral, lapped confines of the primary opening 72A.

A subsequent linear advancement of the modified fastening divice 10 within the embracing engagement of channels 116 and 118, allows the rounded ends 113 of depressant 112 to enact a repeat camming action in connection with the second, perpendicularly aligned, projecting spring actuated catch 20A, upwardly depress said secondary catch and register within the confines of the substantially arced, lapped secondary opening 74A. The automatically accessible, integrated, linear, bifurcated mode of the lapped secondary opening 74A provides this modified fastening device with its width/tension adjustment capacity.

It must be noted that the preset tensility of springs 75 determines the modified versions's ability to prevent the engaged copula keeper unit 110 from passing the restrictive entrants 71A/73A in either direction without some pressure being applied thereto.

Figure 11:
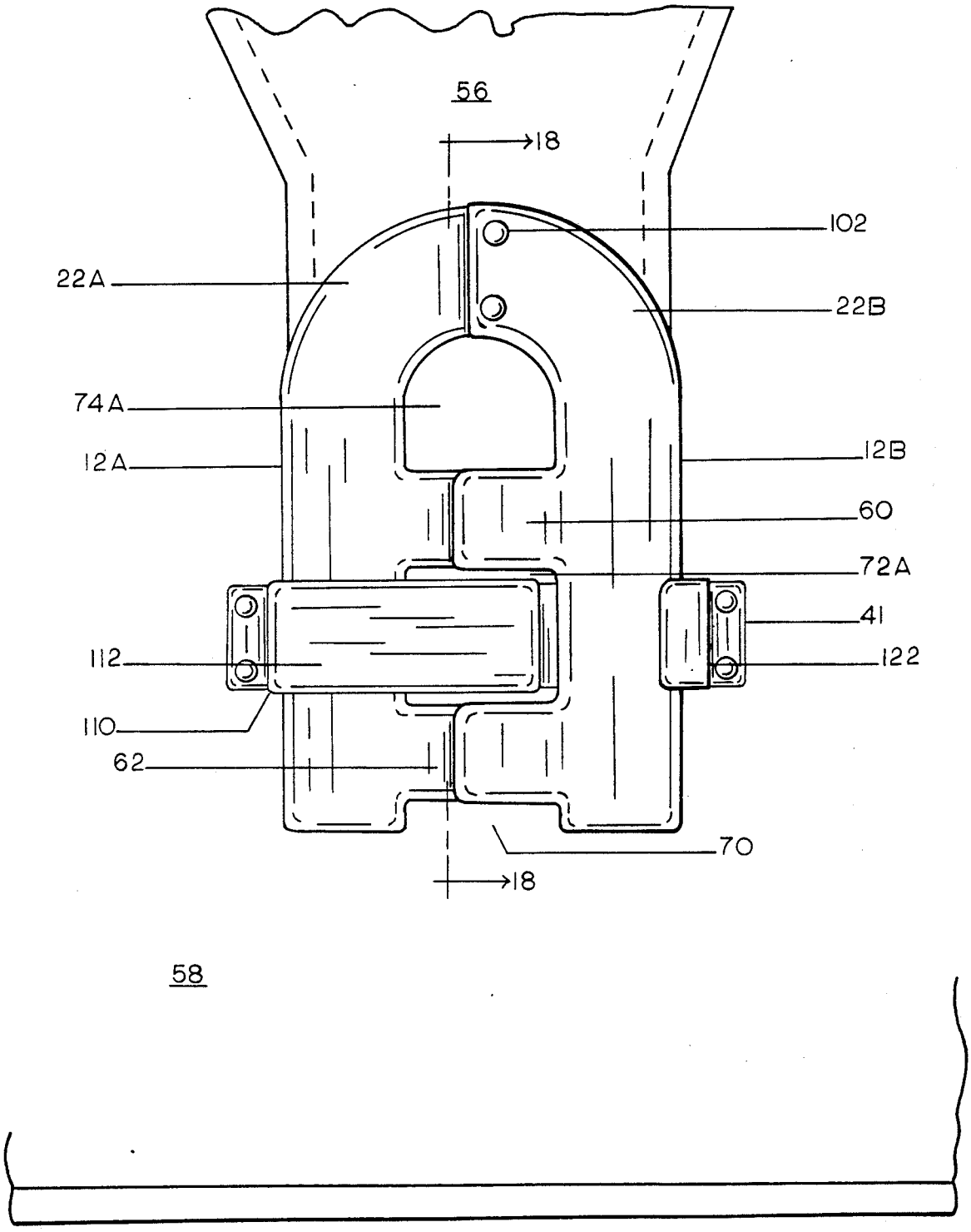
FIG. 11 is an elevated front view of the fastener in another embodiment—engaged with an appropriately configured keeper unit.

Referring to FIGS. 11 and 14, the proposed keeper unit 110 is preferredly formed of cast metal or plastic or blanked to the desired form. Said keeper unit 110 is essentially rectangular in form when viewed in plan (FIG. 11), and cross-sectionally presents a lower placed, essentially rectangular and horizontal channel 116 (for a corresponding and smooth reception) of lower placed arm 12A and its transverse members 62, and an integral essentially vertical channel 118. Channel 116 is formed by an integral, bevel ended top plate/-depressant 112, marginal portions or walls 115, bottom or bed plate 114 which extends integrally, on its right side, and at right angles, to form a flat extension 119 which goes On to form an integral, upwardly extended, substantially at right angles, flat tongue-like free formation 120 which in turn is struck inwardly, substantially at right angles, at its vertex portion 122. In conjunction with flat, vertical element 120, the right angled vertex portion 122 (See FIG. 14) is adapted to properly align as well as confine the overlapping members 12B/60. Said keeper 110 is securely attached, at lateral lugs 41, by conventional means (such as rivets) to the body 58 of a bag or luggage and aligned to receive the incoming modified fastening device.

Figure 17:
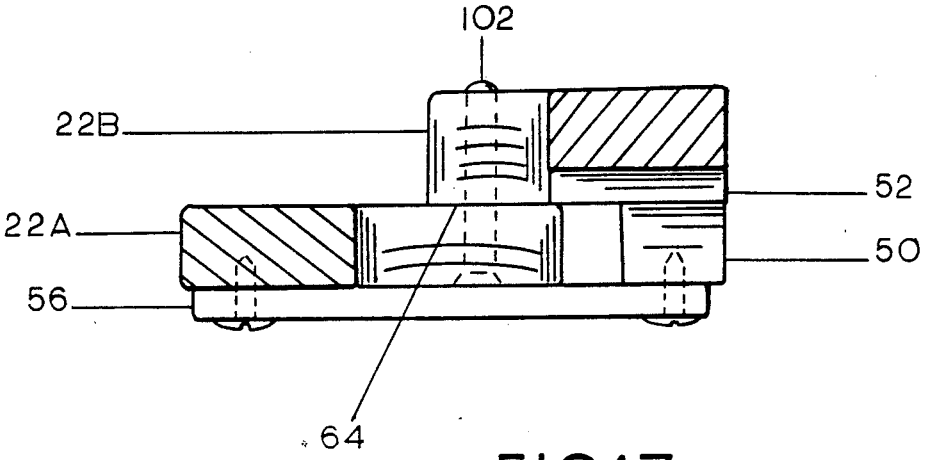
FIG. 17 is a sectional view of FIG. 12 taken along line 17—17.
Figure 18:
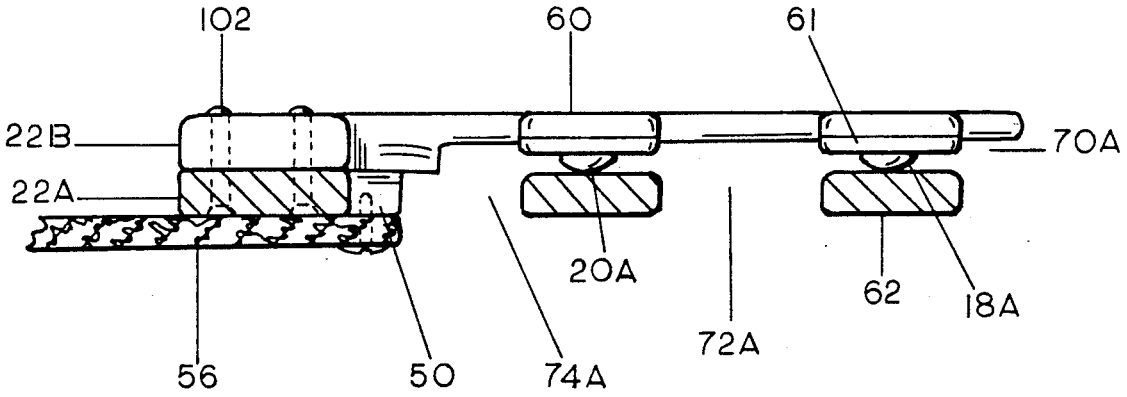
FIG. 18 is a sectional view of FIG. 11 taken along line 18—18.

It must be noted that, (as shown in FIGS. 14 and 17), the protuberant or boss member 50 allows member 12B at its posterior portion 22B to project downwardly to the same reverse-side level of the over-lapped member 12B, and with thread=d apertures 53 provides for an even securement to a closure flap or lid.

In an alternate embodiment (See FIGS. 12 and 16), modified fastening device 10 may be provided, along the lower outer periphery of the lower, overlapped arm 12A with grooves or slots 104A to engage with a cooperating conventional locking member which is preferably attached to the laterality of the copula keeper unit 110, thus investing said arm with hasp-like capacity, and preventing disengagement as a result of lifting a loaded bag or luggage by its handle, particulary when said handle is attached to the same closure flap as the fastening device.

The overlapping embodiment hereinabove described may also be structured to provide a single opening inter-engagement capacity (FIG. 12) with or without the lower placed arm being provided with a groove for a hasp-like engagement with a cooperating, conventional locking member which is integrated with the proposed copula keeper element.

Figure 19:
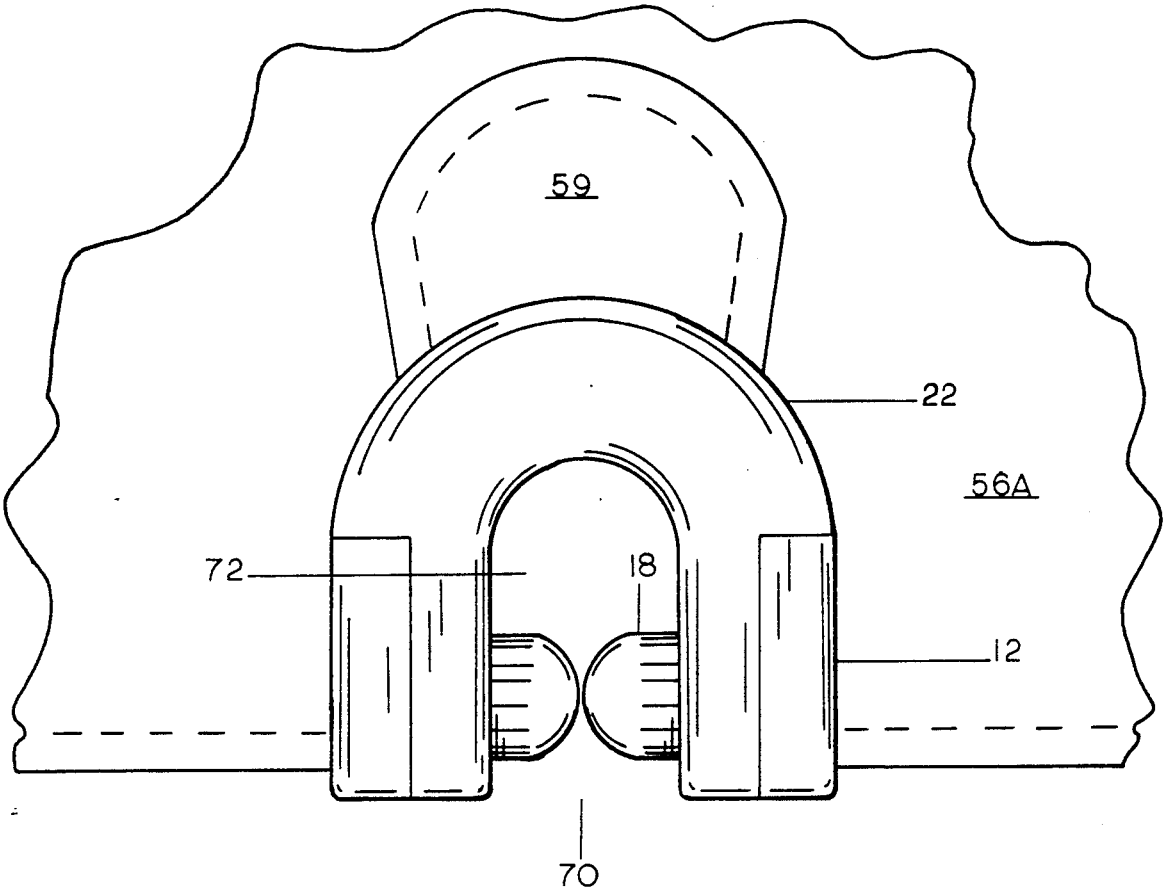
FIG. 19 is an elevated front view of a single opening version of the fastener.
Figure 20:
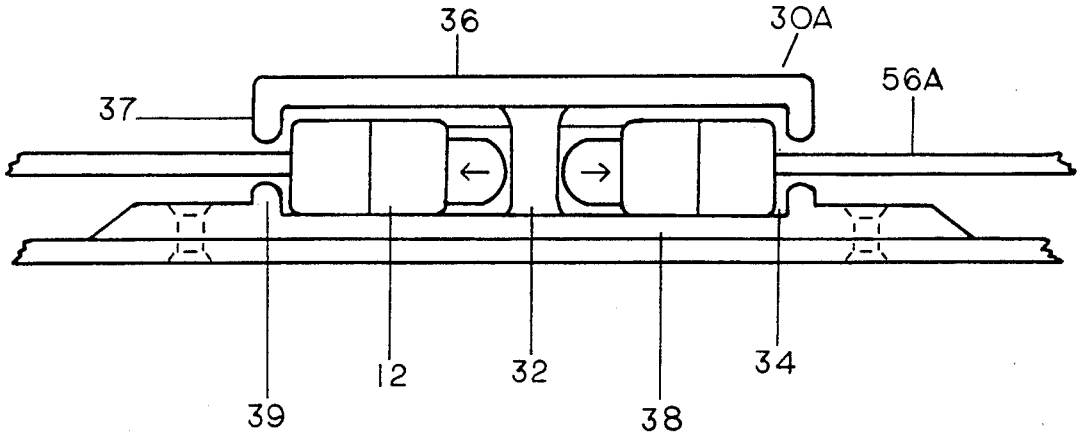
FIG. 20 is a schematic, perpendicular, (anterior) side view of FIG. 19—as it engages with a modified keeper unit.

In a fourth embodiment, (See FIGS. 19 and 20) fastening device 10 may be medially and recessively secured along the periphery of closure flap continuum 56A, thus necessitating the reconfiguration of keeper unit 30 into keeper 30A (FIG. 20).

As with the original, keeper 30A is provided with a pair of overlying, spaced, rectangular plates, 36 and 38, which are integrally connected by an intermediate bifurcating, bevel ended depressant 32. Bifurcated channels 34 along with spaced camming flanges 37 and 39 allow for an effective longitudinal movement of fastener 10 together with its lateral closure flap continuum 56A. Tab member 59 is meant to assist in the push and pull of the present invention. The spaced flanges 37 and 39 by being turned up towards each other function as guide flanges. Said modified keeper 30A is fixedly attached to the body 58 of a bag or luggage and aligned to receive the incoming fastener 10. Similar reconfigurations of the overlapping fastener and its keeper 110 are possible. Said modified keepers may also be provided with lateral conventional locks for cooperation with appropriately formed fasteners of the present invention.

It must be noted that the exterior corners of the descending arms of the above-stated embodiments as well as the leading edges or anterior corners 13 are beveled or rounded. The rounded external corners allows for smooth engagement with the proposed copula keeper units as well as enhancing the fasteners capacity to introduce the lateralized conventional lock member's detentive element (particularly when the same is spring biased) into the tangentially placed grooves 104.

Figure 7:
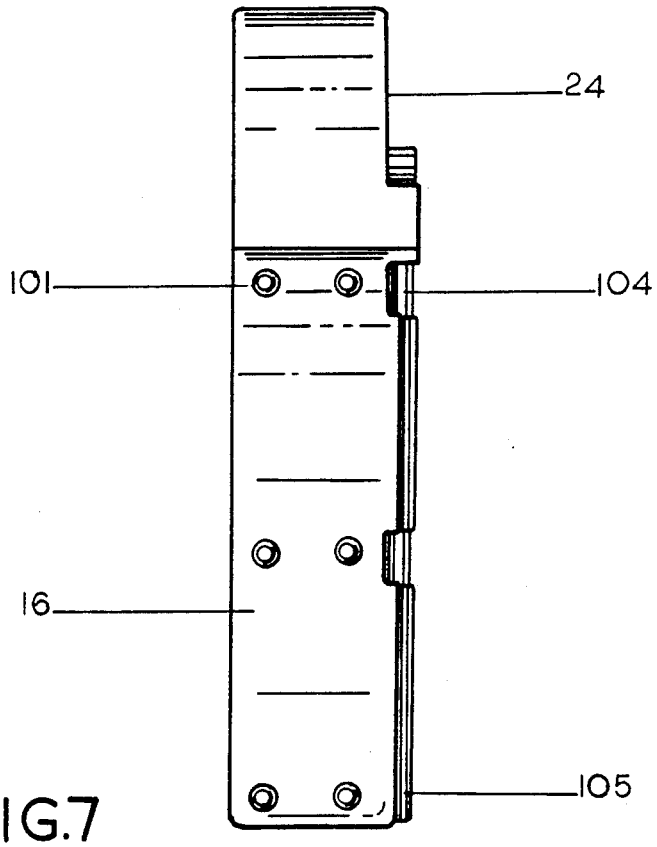
FIG. 7 is a side view of the invention, showing an optional longitudinal arm groove.

To further enhance the introductory capacity of the arm with the receiving grooves 104, said arm may be provided, see FIG. 7, with a longitudinal groove 105 which is tangential to, but not as deep as, the receiving groove(s) or slot(s) 104.

While particular embodiments of the present invention have been disclosed, it is to be understood that various changes may be made in the embodiment of the invention herein specifically described without departing from the true spirit and scope of the appended claims, and nothing herein shall be construed as limitations upon the invention, its concept or structural embodiment as to the whole or any part thereof. For example, the invention, in the preferred forms illustrated, abeit on a much smaller scale, may be provided with thumb/index grips or depressions and arranged to aid the user when attached as fasteners to watch straps or bracelets. Furthermore, the present invention can be used as a fastening element for fine shoes, garments, or as fastening elements for drapery and other similar items.

What is claimed is:

1. A fastening device for bags, luggages and other receptacles comprising:

a bag/luggage fastening device (10), made of cast metal, or plastic or any other suitable material having an essentially u-shaped body which consists of an arced posterior portion (22) which descends to form two laterally spaced arms (12), said arms carrying two projecting pairs of aligned, opposing, compression spring actuated beveled catches (18) and (20), said catches being smooth and rounded and transversely, moveably mounted and coming together to form restrictive entrants (71) and (73) which can be substantially, laterally depressed, said opposing, spring actuated catch pairs (18) and (20) being so located and positioned that said catch members are held in a locking or opening position with respect to a rigid, engaging depressant, and said lateral arms (12) at their anterior portion forming an introductory opening (70) which, when said fastening device (10) is advanced linearly, allows for engagement with said centrally and correctly located depressant, said spring actuated catch pair (18) is laterally depressed, via entrant (71), allowing for the entrance and registration of said engaging depressant member within the confines of the essentially quadrilateral primary opening (72), and upon a subsequent linear advancement of said fastening device (10) said rigid depressant is able to repeat its depressing action, via entrant (73), against the second pair of opposing spring actuated catches (20), thus allowing for the entrance and registration of said depressant within the confines of the essentially arced secondary opening (74).

2. A fastening device of claim 1 wherein the arced, posterior portion (22) is provided, rearwardly, with a depression (24) which is formed with a plurality of threaded apertures for the attachment of a flap or lid thereto.

3. A fastening device of claim 1 wherein said descending arms are dichotomized into inner contiguous bars (16) and outer bars (14) which are provided with appropriate transverse bores for an effective mounting of said spring and catch elements.

4. A fastening device of claim 3 wherein said arced portion (22) descends, and inclines at right angles to form counter walls (90) and goes on to form two laterally spaced, descending, contiguous inner bars (16) which are preferably provided with pairs of cylindrical portional bores (80B), smaller, centered, within said portional bores, annular bearings (84) which forms rims (87), and a through-opening for the projecting catches, intermediate projecting plugs (88), and pairs of essentially rectangular depressions (92), which straddle said projecting plugs, and exist to provide lightness to the said bars.

5. A fastening device of claim 3 wherein said outer bars (14) are provided with appropriately positioned pairs of cylindrical portional bores (80A), pairs of smaller, centered, within said portional bores, annular recessions (82) which provide rearward containment, abutment as well as self-centering capacity to springs (75), and intermediate, essentially rectangular, transverse sockets (86) which are structured to interfit with plugs (88).

6. A fastening device of claim 1 wherein said catches, essentially round and plug-like in formation, are formed with substantially cylindrical bodies (19) which have rounded anteriors (21), and rear annular collars (23), said collars being rearwardly provided with hub-like central plugs (25) which provide self-centering engagements with the front ends of springs (75), and in fully extended locking positions, said catches are retained by the abutment capacity of rims (87).

7. A fastening device of claim 5 wherein bars (14) and (16) are conjoined, after said spring/catch combinations are mounted, thus providing transverse cavities for the slideable movement of said projecting pairs of spring actuated catches.

8. A fastening device of claim 7 wherein bars (14) and (16) are fixedly connected to each other and are rigidly secured together by any suitable means such as by a plurality of rivets, or solder or other adhesive.

9. A fastening device of claim 8 wherein the exterior corners of the conjoined bars as well as their leading edges (13) are beveled.

10. A fastening device of claim 1 wherein one of the descending arms is provided with grooves (104) which provides lateral engagement capacity with a cooperating conventional locking member which is integrated with said keeper unit.

11. A fastening device of claim 10 wherein, in order to enhance the introductory capacity of the arm (12) with the receiving grooves (104), said arm is provided with a longitudinal groove (105) which is tangential to, but not as deep as, said receiving grooves.

12. A fastening device of claim 1 wherein said secondary opening (74) being a bifurcated continuum of primary opening (72) provides width and tension adjustment capacity to the fastening system.

13. A fastening device of claim 1 wherein the pre-set tensility of springs (75) determines the degree by which the fastening system is able to prevent said engaging depressant element from passing restrictive entrants (71) and (73) in either direction without some pressure being applied thereto.

14. A fastening device for bags, luggages and other receptacles comprising:

a fastening device, made of cast metal or plastic or any other suitable material, having an essentially u-shaped body which consists of overlapping posterior portions (22A) and (22B) their respective contiguous, descending arms (12A) and (12B) which have perpendicular members (62) and (60) respectively, said perpendicular members (60) being provided at their anterior portions, with downward projecting compression spring actuated beveled catches (18A) and (20A), said beveled catches, in a vertical alignment, resting their rounded anteriors on top of underlying members (62) to form restrictive entrants (71A) and (73A), said descending arms forming introductory opening (70A), lapped openings (72A) and (74A), and when said overlapping fastening device is advanced linearly for engagement, said opening (70A) introduces said fastening device to a depressant element which upwardly depresses spring actuated catch (18A), via restrictive entrant (71A), allowing for the entrance and registration of the engaging depressant within the confines of the essential quadrilateral, lapped primary opening (72A); and, upon a subsequent linear advancement of said overlapping fastening device, said depressant is able to repeat its depressing action, via entrant (73A), against the second spring actuated catch (20A) thus allowing for the entrance and registration of said depressant within the confines of the essentially arced, lapped secondary opening (74A).

15. A fastening device of claim 14 wherein said member (12B) at its semi-arced posterior portion (22B) is provided, rearwardly, with a boss member (50) which may be provided with a threaded aperture (53) and which projects from an elevated, essentially flat surface (52), said boss member (50) allows said overlying member (22B) to achieve the same posterior, rearward plane as portion (22A), thus providing level attachment points for flaps or lids.

16. A fastening device of claim 14 wherein said perpendicular members (60) are rearwardly provided, at their anterior portions, with cylindrical portional bores (80A) and smaller, centered, within said portional bores, posterior annular recesses (82) for the abutment and containment of compression springs (75), said anterior portions, being conjoined, by rivets, soldering or the like, with essentially rectangular underplates (61) which are correspondingly provided with matching cylindrical portional bore (80B) which communicates with centered, within said portional bores, annular bearings (84), which forms rims (87) and through-openings for the projecting catches, said conjoined bores thus forming cylindrical chambers for the transverse, slideable movement of the mounted compression spring/catch combinations.

17. A fastening device of claim 14 wherein elements (12A) and (12B) along their overlapping, semi-arced posterior portions are, at lap joint (64), rigidly conjoined by any suitable means of securement.

18. A fastening device of claim 14 wherein the preset tensility of springs (75) determines the degree by which the fastening system is able to prevent said engaging depressant element from passing restrictive entrants (71A) and (73A) in either direction without some pressure being applied thereto.

19. A fastening device of claim 14 wherein the descending arm (12A) is provided with grooves (104A) which provides lateral engagement capacity with a cooperating conventional locking member.

20. A fastening device of claim 14 wherein the exterior corners of the descending bars and their loading edges (13) are beveled.

21. A fastening device of claim 14 wherein, in order to enhance the introductory capacity of the arm (12A) with the receiving grooves (104A), said arm is provided with a longitudinal groove (105) which is tangential to, but not as deep as, said receiving grooves.

22. A fastening device for bags, luggages and other receptacles comprising:

a fastening device, made of cast metal, or plastic or any other suitable material having an essentially u-shaped body which consists of overlapping posterior portions (22A) and (22B) their respective contiguous descending arms (12A) and (12B) which have perpendicular members (62) and (60) respectively, said perpendicular member (60) being provided, at its anterior portion, with downward projecting compression spring actuated beveled catch (18A), said beveled catch, in a vertical alignment, resting its rounded anterior on top of underlying member (62) to form restrictive entrant (71A), said descending arms forming introductory opening (70A), and lapped opening ($72A_1$), and when said overlapping fastening device is advanced linearly for engagement, said opening (70A) introduces said fastening device to a depressant element which upwardly depresses spring actuated catch (18A), via restrictive entrant (71A), allowing for the entrance and registration of the engaging depressant within the confines of the essentially arced, lapped opening ($72A_1$).

23. A fastening device of claim 22 wherein the descending arm (12A) is provided with a groove which provides lateral engagement capacity with a cooperating conventional locking member.

24. A fastening device of claim 22 wherein the exterior corners of the descending bars and their leading edges are beveled.

25. A fastening device of claim 22 wherein, in order to enhance the introductory capacity of (12A) with the receiving groove 104A, said arm is provided with a longitudinal groove which is tangential to, but not as deep as, said receiving groove.

* * * * *